US005664875A

United States Patent [19]

Hegedus

[11] Patent Number: 5,664,875

[45] Date of Patent: Sep. 9, 1997

[54] BARBECUE GRILL LIGHT

[76] Inventor: Barnard Hegedus, 15 Burns Ave., Melville, N.Y. 11747

[21] Appl. No.: 646,955

[22] Filed: May 8, 1996

[51] Int. Cl.[6] ..... F21V 21/08; F21L 15/20

[52] U.S. Cl. ..... 362/191; 362/92; 362/198; 362/399; 362/396; 362/419; 248/228.6

[58] Field of Search ..... 362/191, 190, 362/92, 396, 419, 418, 253, 335, 277, 280, 282, 319, 399, 198; 248/229.15, 229.25, 228.6

[56] References Cited

U.S. PATENT DOCUMENTS

| | | | |
|---|---|---|---|
| 1,648,709 | 11/1927 | Winsell . | |
| 3,301,513 | 1/1967 | Sugaya | 248/228.6 |
| 3,992,618 | 11/1976 | Matthews et al. | 362/396 |
| 5,163,752 | 11/1992 | Copeland et al. . | |
| 5,180,220 | 1/1993 | Van Kalsbeek | 362/396 |
| 5,203,622 | 4/1993 | Sottile | 362/198 |
| 5,257,169 | 10/1993 | Waalendziak . | |
| 5,276,596 | 1/1994 | Krenzel | 362/396 |
| 5,448,459 | 9/1995 | Rogers . | |
| 5,517,392 | 5/1996 | Rousso et al. | 362/198 |

*Primary Examiner*—Thomas M. Sember
*Attorney, Agent, or Firm*—Michael I. Kroll

[57] ABSTRACT

A barbecue grill light (10) comprising a housing (12). A structure (14) is for mounting the housing (12) to a side platform board (16) of a barbecue grill (18), having a cooking grate (20). An elongate flexible gooseneck shaft (22) has a lower end connected to the housing (12). An assembly (24) for illuminating is affixed to an upper end of the elongate flexible gooseneck shaft (22). The illuminating assembly (24) can be directed at food (26) cooking on the cooking grate (20) of the barbecue grill (18) at night, to allow a person using the barbecue grill (18) to see the food (26) cooking.

14 Claims, 3 Drawing Sheets

58
38
24
4
26
54
56
52
22
10
60
70
12
16
18
20
2
62
28
14
68
3

20
18
22
10
12
70
68
62
38
32
28
30
14
34
16

BARBECUE GRILL LIGHT

BACKGROUND OF THE INVENTION

1. Field of the Invention

The instant invention relates generally to portable lighting devices and more specifically it relates to a barbecue grill light.

2. Description of the Prior Art

Numerous portable lighting devices have been provided in prior art. For example, U.S. Pats. Nos. 1,648,709 to Winsell; 5,163,752 to Copeland et al.; 5,257,169 to Walendziak and 5,448,459 to Rogers all are illustrative of such prior art. While these units may be suitable for the particular purpose to which they address, they would not be as suitable for the purposes of the present invention as heretofore described.

WINSELL, WILLIAM R.

PORTABLE ELECTRIC LAMP

U.S. Pat. No. 1,648,709

A lamp comprising a cylindrical casing. a cap on one end of the casing has a conical, closed end provided with a reflecting surface. A lamp socket is concentric with the closed end. A lamp bulb is in the socket. A sleeve slideably mounted on the casing has a flared outer end movable into a concentric overlapping relation with the conical reflector for the purpose set forth. The sleeve has means thereon engaging the cap to limit the movement thereof.

COPELAND, DEBRA L.

HARDISON, CHARLIE W.

FLASHLIGHT HOLDER APPARATUS

U.S. Pat. No 5,163,752

A holder includes a "C" shaped clamp member arranged to secure an articulated elongate positioning tube. The positioning tube is fixedly received within a mounting plate that in turn secures a flashlight member thereto. In a modification, a fiber optic cable includes a first end and a second end. A suction cup member receives the second end coaxially thereof permitting securement of the suction cup to the flashlight lens, providing for illumination within limited geometric confinements.

WALENDZIAK, RICHARD W.

BARBECUE GRILL LIGHTING APPARATUS

U.S. Pat. No. 5,257,169

A lighting apparatus is arranged for fixed securement to an upper barbecue grill housing in adjacency and positioned below a handle. Upon lifting of the upper housing relative to a lower housing of a barbecue grill structure, the illumination member directs illumination onto an underlying barbecue grill grate. The housing includes a generator and in operative communication with rechargeable batteries to effect selective illumination of illumination bulbs contained within the housing.

ROGERS, CLISSIE M.

CLIP-ON PENLIGHT

U.S. Pat. No. 5,448,459

A small, self contained light, swivel mounted on a clasp that will grip cylindrically shaped objects including pens, pencil and fingers. The cone shaped light body includes a lens, reflector, bulb, battery and switch.

SUMMARY OF THE INVENTION

A primary object of the present invention is to provide a barbecue grill light that will overcome the shortcomings of the prior art devices.

Another object is to provide a barbecue grill light that can be installed conveniently on a barbecue grill, so as to illuminate food cooking on a grate at night, to enable a person using the barbecue grill to see the food cooking.

An additional object is to provide a barbecue grill light in which the light can be safely directed at the food cooking on the grate, by using an insulated wand connected to an elongate flexible gooseneck shaft, so that the light can be properly aimed thereto.

A further object is to provide a barbecue grill light that is simple and easy to use.

A still further object is to provide a barbecue grill light that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
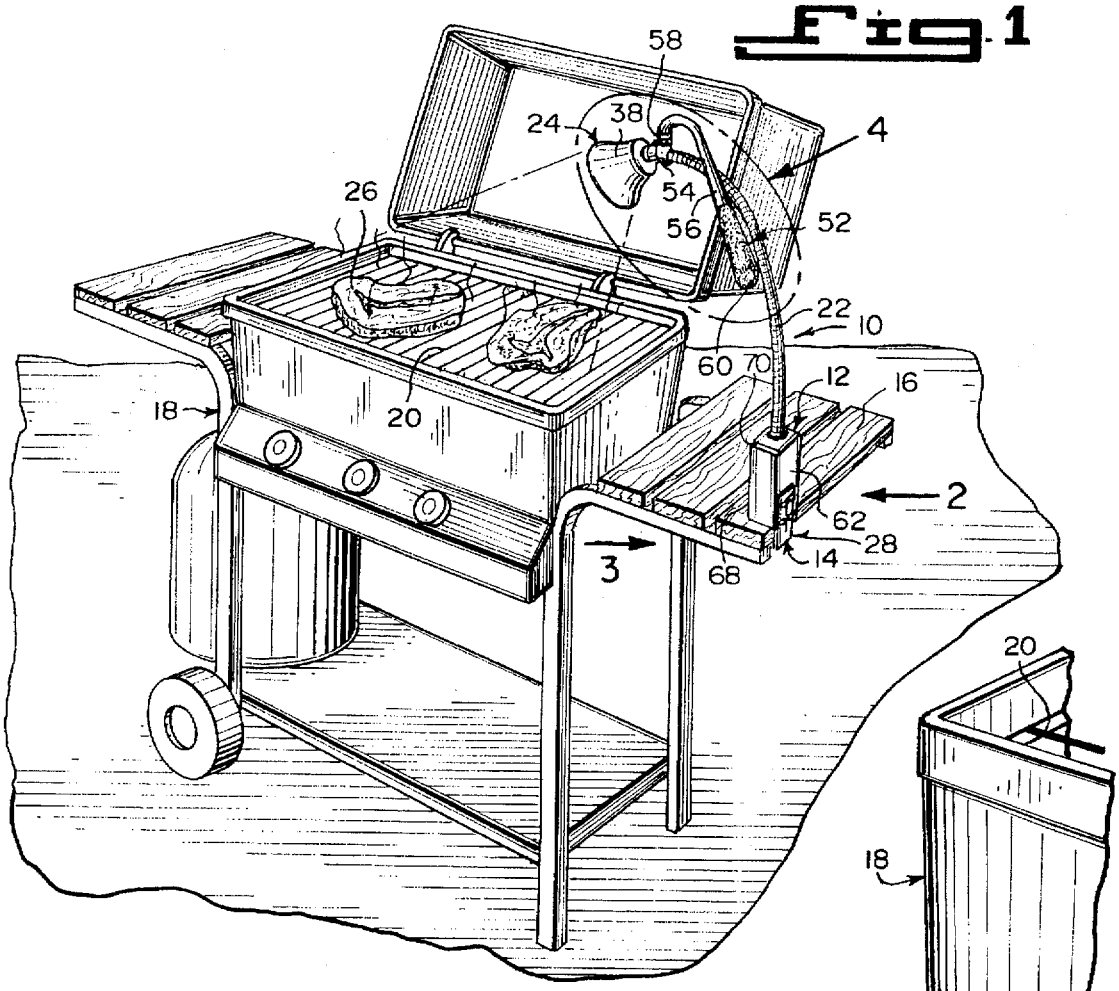
FIG. 1 is a perspective view showing a first embodiment of the instant invention installed on a barbecue grill, to illuminate food cooking on a grate at night.
Figure 2:
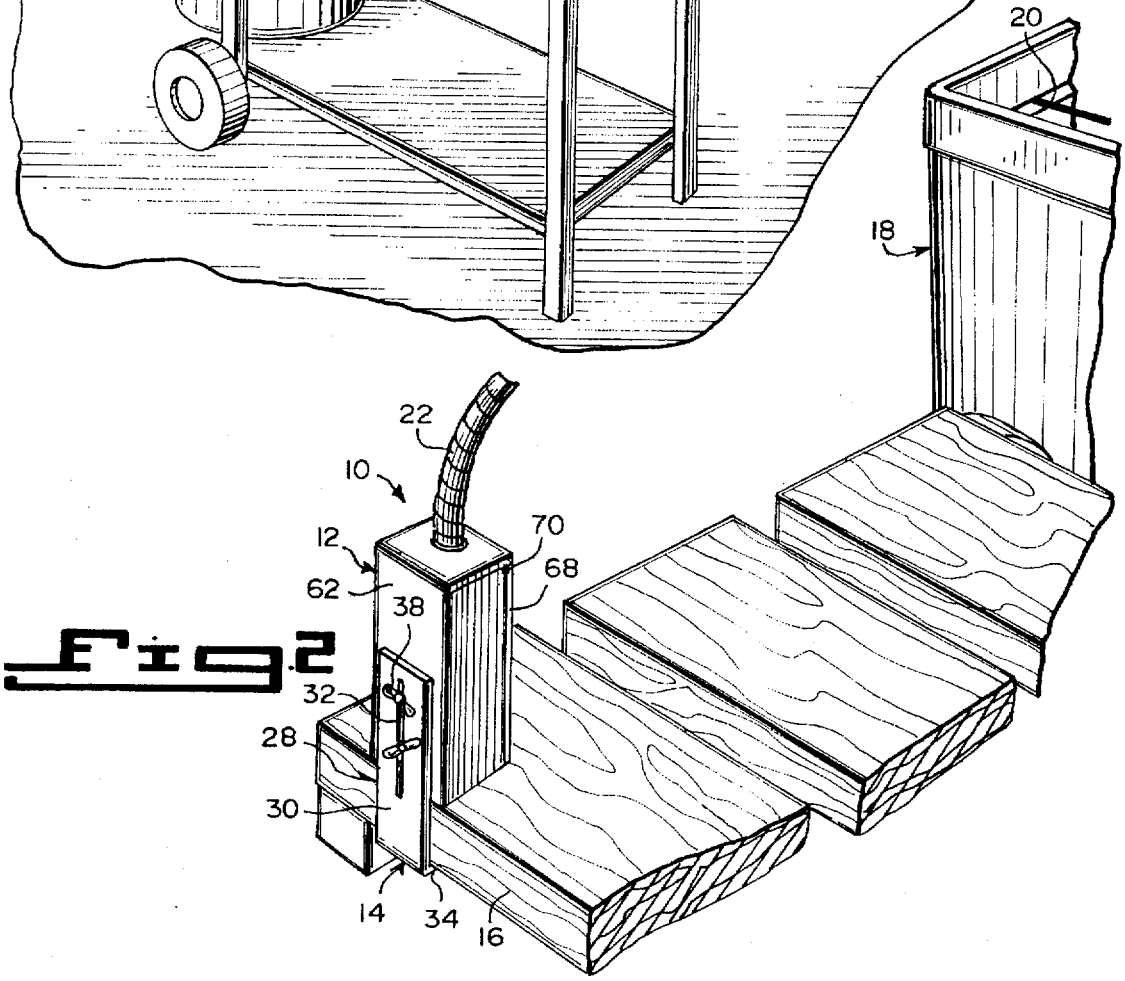
FIG. 2 is an enlarged rear perspective view taken in the direction of arrow 2 in FIG. 1, with parts broken away.

Turning now descriptively to the drawings, in which similar reference characters denote similar elements throughout the several views, FIGS. 1 through 6 illustrate a barbecue grill light 10 comprising a housing 12. A structure 14 is for mounting the housing 12 to a side platform board 16 of a barbecue grill 18, having a cooking grate 20. An elongate flexible gooseneck shaft 22 has a lower end connected to the housing 12. An assembly 24 for illuminating is affixed to an upper end of the elongate flexible gooseneck shaft 22. The illuminating assembly 24 can be directed at food 26 cooking on the cooking grate 20 of the barbecue grill 18 at night, to allow a person using the barbecue grill 18 to see the food 26 cooking.

The mounting structure 14 includes an L-shaped bracket 28, having a vertical arm 30 with a longitudinal-slot 32 therein and a horizontal arm 34 with a non-slip inner surface 36. A pair of wing head bolts 38 are spaced apart and threaded into one side of the housing 12 through the longitudinal slot 32. When the wing head bolts 38 are tightened against the vertical arm 30 after adjustment, the non-slip inner surface 36 of the horizontal arm 34 can clamp against the underside of the side platform board 16 of the barbecue grill 18, to hold the housing 12 stationary thereto.

The illuminating assembly 24 consists of a shade body 38 affixed to the upper end of the elongate flexible gooseneck shaft 22. A reflector 40 is carried within the shade body 38. A lamp socket 42 is concentric within the reflector 40. A lamp bulb 44 is in the socket 42. A parabolic lens 46 is on a forward end of the shade body 38. A power supply 48 is in operative association with the lamp bulb 44 through the elongate flexible gooseneck shaft 22. A switch 50 on the shade body 38 is electrically connected between the lamp socket 42 and the power supply 48. The switch 50 can be manually operated to turn the lamp bulb 44 on and off.

The barbecue grill light 10, shown in FIGS. 1, 3, 4 and 5, can further include an insulated wand 52 connected to the elongate flexible gooseneck shaft 22 near the upper end. The person can grasp the insulated wand 52, to safely manipulate the elongate flexible gooseneck 22 to aim the illuminating assembly 24 directly at the food 26 cooking on the cooking rate 20 of the barbecue grill 10 at night.

The insulated wand 52 contains a lock-on clamp 54, to engage with the elongate flexible gooseneck shaft 22. A J-shaped handle 56 extends from the lock-on clamp 54. A swivel ball joint 58 is between the lock-on clamp 54 and the J-shaped handle 56. A head protective grip 60 is on a free end of the J-shaped handle 56.

Figure 3:
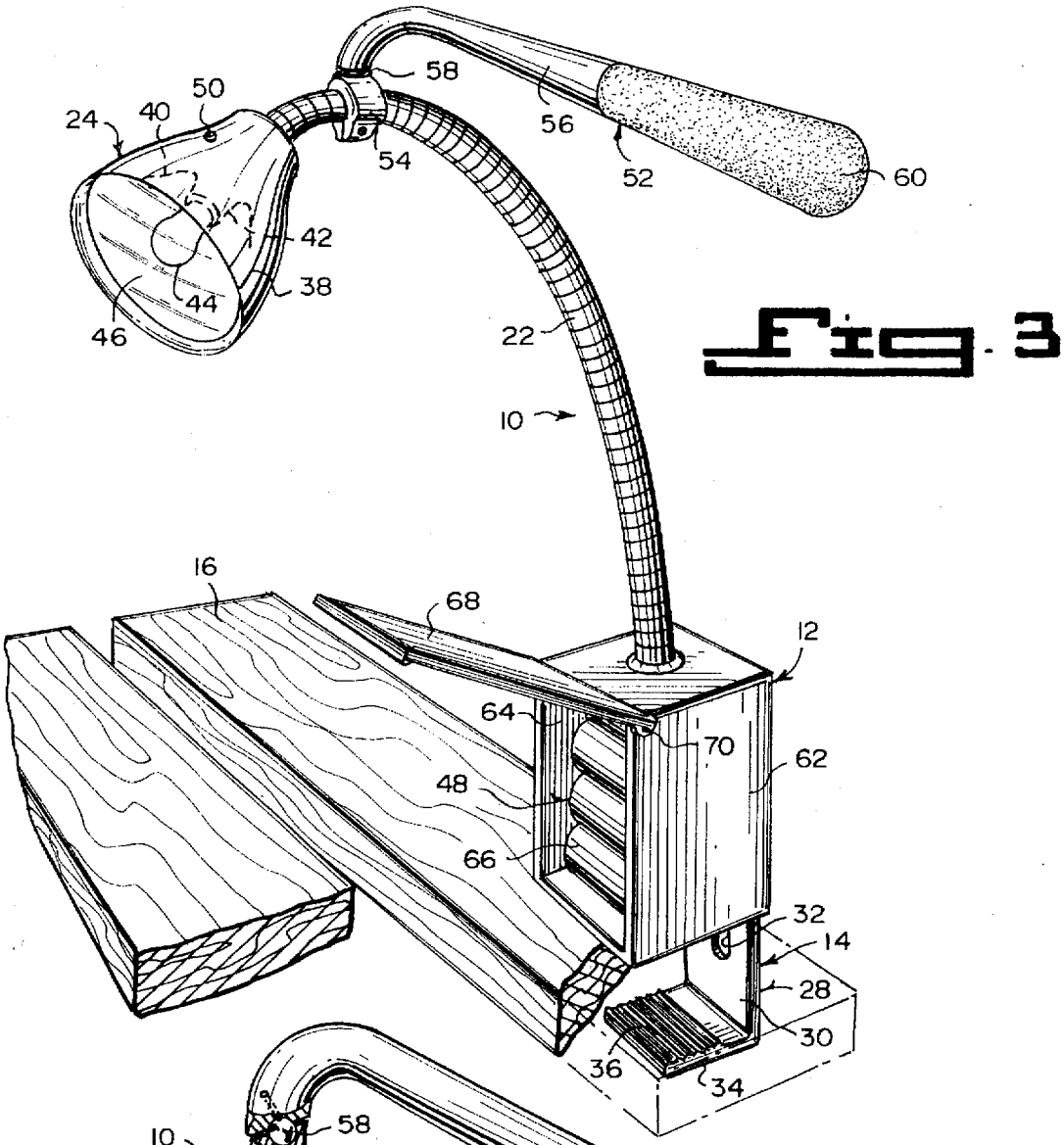
FIG. 3 is an enlarged front perspective view taken in the direction of arrow 3 in FIG. 1, with parts broken away.
Figure 4:
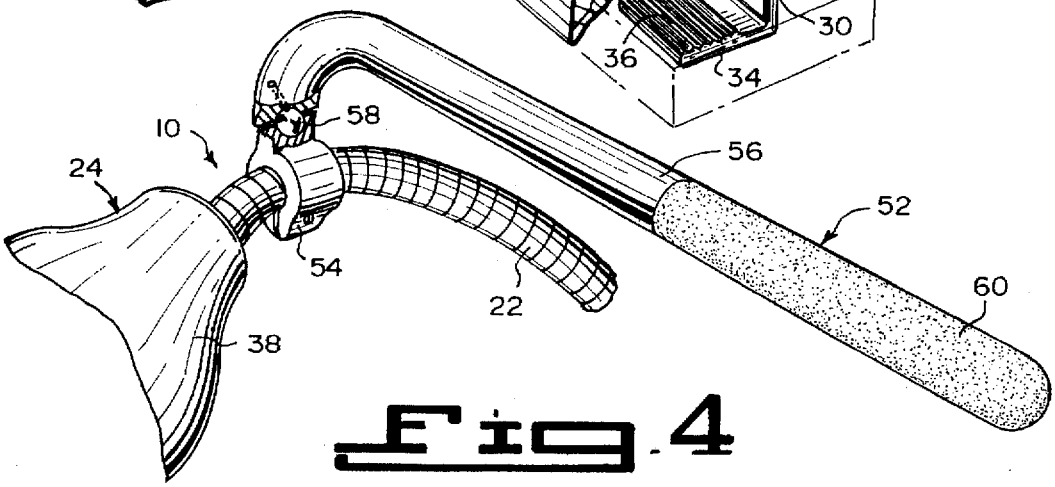
FIG. 4 is an enlarged perspective view of the area in FIG. 1 as indicated by arrow 4, with parts broken away and in section, to show the ball joint in the insulated wand in greater detail.

The housing 12 is a rectangular shaped casing 62. The mounting structure 14 will maintain the rectangular shaped casing 62 to the side platform board 16 of the barbecue grill 18 on a short side in an upright position. The rectangular shaped casing 62, as best seen in FIG. 3, has a compartment 64 therein. The power supply 48 being a plurality of batteries 66 is placed within the compartment 64. A door 68 is hinged at 70 on one side of the rectangular shaped casing 62, so that the person can have access into the compartment 64 to remove and replace said batteries 66.

Figure 6:
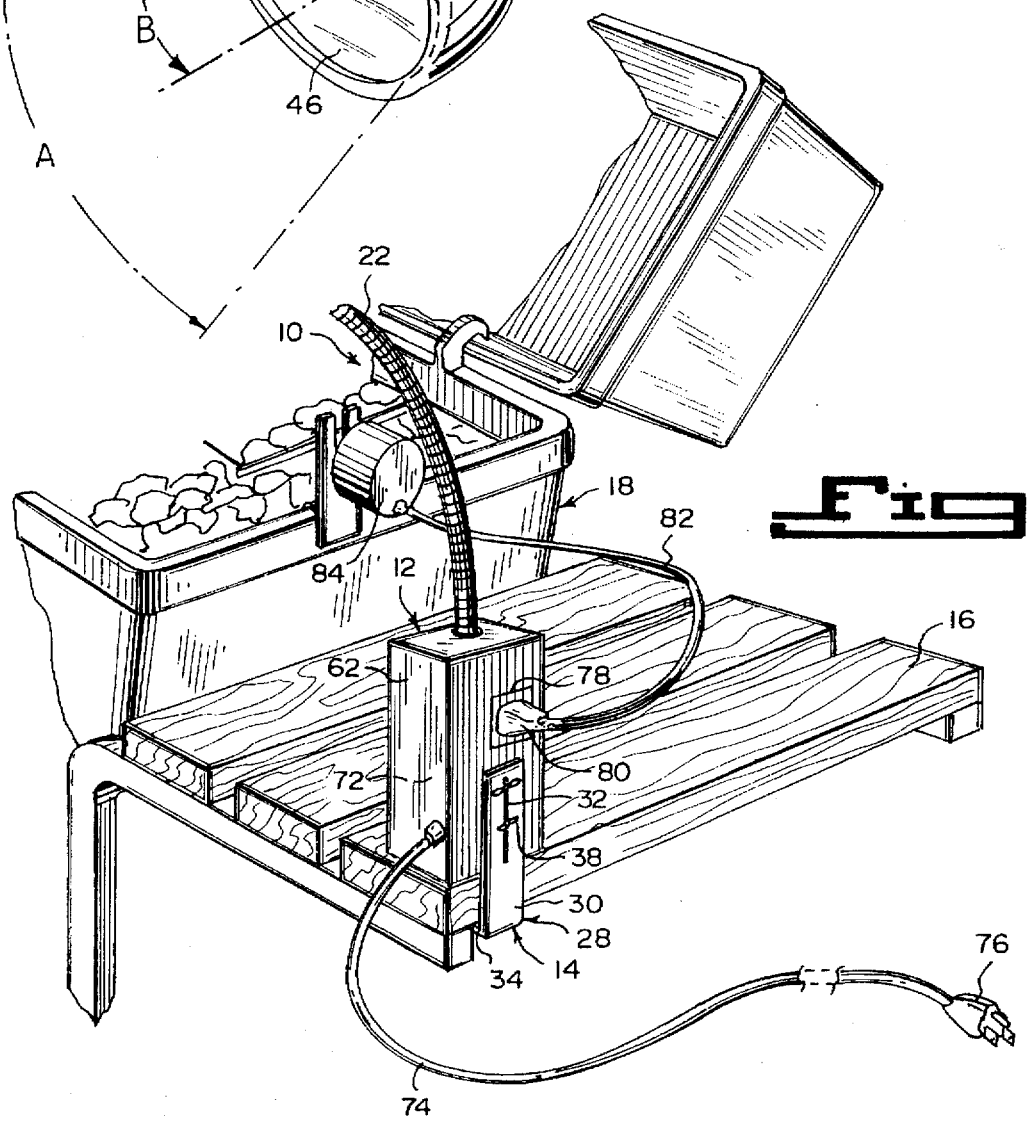
FIG. 6 is a perspective view of a third embodiment with parts broken away, showing an AC power unit built therein with a connection to a rotisserie motor on the barbecue grill.

In FIG. 6, the rectangular shaped casing 62 has a built-in junction box 72, to receive wiring in the elongate flexible gooseneck shaft 22 from the lamp socket 42. An electrical cord 74 extends into the junction box 72, to connect to the wiring. A plug 76 is on a distal free end of the electrical cord 74. The plug 76 can engage with a wall outlet (not shown) to receive AC power therefrom, to supply electricity to the lamp socket 42 when the switch 50 is turned on.

A socket 78 is mounted in the rectangular shaped casing 62 and is electrically connected to the electrical cord 74 within the junction box 72. A plug 80 on an electrical cord 82 from a rotisserie motor 84 on the barbecue grill 18 can be plugged into the socket 78, to receive AC power therefrom.

Figure 5:
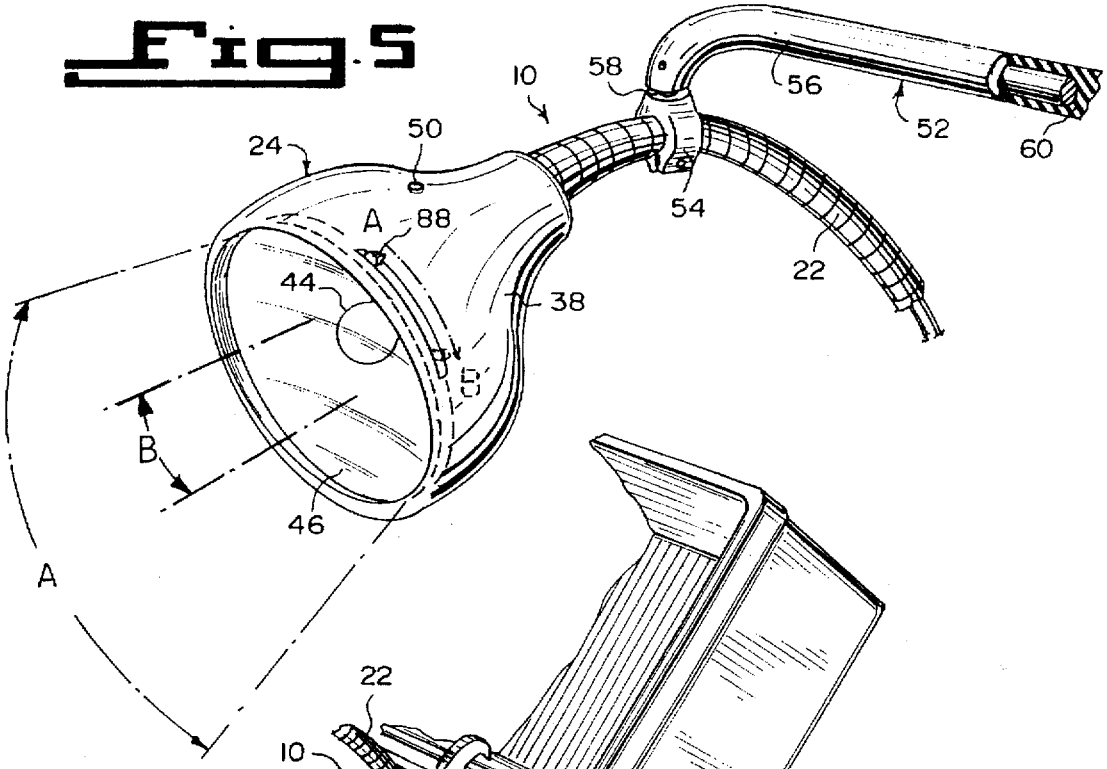
FIG. 5 is an enlarged perspective view similar to FIG. 4, showing a second embodiment in which the lens is adjustable to concentrate the light beam therefrom.

In FIG. 5, a mechanism 88 is built into the shade body 38 to adjust the parabolic lens 46, so as to concentrate a light beam A to B coming therefrom onto the food 26 cooking on the cooking grate 20 of the barbecue grill 18.

LIST OF REFERENCE NUMBERS 10 barbecue grill light
12 housing of 10
14 mounting structure of 10
16 side platform board of 18
18 barbecue grill
20 cooking grate on 18
22 elongate flexible gooseneck shaft of 10
24 illuminating assembly
26 food on 20
28 L-shaped bracket of 14
30 vertical arm of 28
32 longitudinal slot in 30
34 horizontal arm of 28
36 non-slip inner surface of 34
38 shade body of 24
40 reflector of 24
42 lamp socket of 24
44 lamp bulb of 24
46 parabolic lens of 24
48 power supply of 24
50 switch of 24
52 insulated wand on 22
54 lock-on clamp of 52
56 J-shaped handle of 52
58 swivel ball joint of 52
60 heat protective grip of 52
62 rectangular shaped casing for 12
64 compartment in 62
66 battery of 48
68 door
70 hinge for 68 on 62
72 built-in junction box in 62
74 electrical cord into 72
76 plug on 74
78 socket in 62 connected to 74
80 plug on 82
82 electrical cord from 84
84 rotisserie motor on 18
86 light beam concentrate mechanism
88 light beam concentrate mechanism in 38

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected Letters Patent is set forth in the appended claims:

1. A barbecue grill light comprising:

a) a housing;

b) means for mounting said housing to a side platform board of a barbecue grill having a cooking grate, wherein said mounting means includes:

i) an L-shaped bracket having a vertical arm with a longitudinal slot therein and a horizontal arm with a non-slip inner surface; and ii) a pair of wing head bolts, that are spaced apart and threaded into one side of said housing through said longitudinal slot, so that when said wing head bolts are tightened against said vertical arm after adjustment, said non-slip inner surface of said horizontal arm can clamp against an underside of the side platform board of the barbecue grill to hold said housing stationary thereto;

c) an elongate flexible gooseneck shaft, having a lower end connected to said housing; and d) means for illuminating affixed to an upper end of said elongate flexible gooseneck shaft, so that said illuminating means can be directed at food cooking on the cooking grate of the barbecue grill at night, to allow a person using the barbecue grill to see the food cooking.

2. A barbecue grill light comprising:

a) a housing;

b) means for mounting said housing to a side platform board of barbecue grill having a cooking grate;

c) an elongate flexible gooseneck shaft, having a lower end connected to said housing; and d) means for illuminating affixed to an upper end of said elongate flexible gooseneck shaft, so that said illuminating means can be directed at food cooking on the cooking grate of the barbecue grill at night, to allow a person using the barbecue grill to see the food cooking and e) an insulated wand connected to said elongate flexible gooseneck shaft near the upper end, so that the person can grasp said insulated wand to safely manipulate said elongate flexible gooseneck to aim said illuminating means directly at the food cooking on the cooking grate of the barbecue grill at night.

3. A barbecue grill light as recited in claim 2, wherein said insulated wand includes:

a) a lock-on clamp to engage with said elongate flexible gooseneck shaft;

b) a J-shaped handle extending from said lock-on clamp;

c) a swivel ball joint between said lock-on clamp and said J-shaped handle; and d) a heat protective grip on a free end of said J-shaped handle.

4. A barbecue grill light as recited in claim 2, wherein said mounting means includes:

a) an L-shaped bracket having a vertical arm with a longitudinal slot therein and a horizontal arm with a non-slip inner surface; and b) a pair of wing head bolts, that are spaced apart and threaded into one side of said housing through said longitudinal slot, so that when said wing head bolts are tightened against said vertical arm after adjustment, said non-slip inner surface of said horizontal arm can clamp against an underside of the side platform board of the barbecue grill to hold said housing stationary thereto.

5. A barbecue grill light as recited in claim 4, wherein said illuminating means includes:

a) a shade body affixed to the upper end of said elongate flexible gooseneck shaft;

b) a reflector carried within said shade body;

c) a lamp socket concentric within said reflector;

d) a lamp bulb in said socket;

e) a parabolic lens on a forward end of said shade body;

f) a power supply in operative association with said lamp bulb through said elongate flexible gooseneck shaft; and g) a switch on said shade body electrically connected between said lamp socket and said power supply, whereby said switch can be manually operated to turn said lamp bulb on and off.

6. A barbecue grill light as recited in claim 5, wherein said insulated wand includes:

a) a lock-on clamp to engage with said elongate flexible gooseneck shaft;

b) a J-shaped handle extending from said lock-on clamp;

c) a swivel ball joint between said lock-on clamp and said J-shaped handle; and d) a heat protective grip on a free end of said J-shaped handle.

7. A barbecue grill light as recited in claim 6, wherein said housing is a rectangular shaped casing, whereby said mounting means will maintain said rectangular shaped casing to the side platform board of the barbecue grill on a short side in an upright position.

8. A barbecue grill light as recited in claim 7, further including:

a) said rectangular shaped casing having a compartment therein;

b) said power supply being a plurality of batteries placed within said compartment; and c) a door hinged on one side of said rectangular shaped casing, so that the person can have access into said compartment to remove and replace said batteries.

9. A barbecue grill light as recited in claim 7, further including:

a) said rectangular shaped casing having a built-in junction box, to receive wiring in said elongate flexible gooseneck shaft from said lamp socket;

b) an electrical cord extending into said junction box for connecting to the wiring; and c) a plug on a distal free end of said electrical cord, whereby said plug can engage with a wall outlet to receive AC power therefrom, to supply electricity to said lamp socket when said switch is turned on.

10. A barbecue grill light as recited in claim 9, further including a socket mounted in said rectangular shaped casing and electrically connected to said electrical cord within said junction box, so that a plug on an electrical cord from a rotisserie motor on said barbecue grill can be plugged into said socket to receive AC power therefrom.

11. A barbecue grill light comprising:

a) a housing which is a rectangular shaped casing;

b) means for mounting said housing to a side platform board of a barbecue grill having a cooking grate, whereby said mounting means will maintain said rectangular shaped casing to the side platform board of the barbecue grill on a short side in an upright position;

c) an elongate flexible gooseneck shaft, having a lower end connected to said housing; and d) means for illuminating affixed to an upper end of said elongate flexible gooseneck shaft, so that said illuminating means can be directed at food cooking on the cooking grate of the barbecue grill at night, to allow a person using the barbecue grill to see the food cooking, said illuminating means including i) a shade body affixed to the upper end of said elongate flexible gooseneck shaft; ii) a reflector carried within said shade body; iii) a lamp socket concentric within said reflector; iv) a lamp bulb in said socket: v) a parabolic lens on a forward end of said shade body; vi) a power supply in operative association with laid lamp bulb through said elongate flexible gooseneck shaft; and vii) a switch on said shade body electrically connected between said lamp socket and said power supply, whereby said switch can be manually operated to turn said lamp bulb on and off.

12. A barbecue grill light as recited in claim 11, further including:

a) said rectangular shaped casing having a compartment therein;

b) said power supply being a plurality of batteries placed within said compartment; and c) a door hinged on one side of said rectangular shaped casing, so that the person can have access into said compartment to remove and replace said batteries.

13. A barbecue grill light as recited in claim 11, further including:

a) said rectangular shaped casing having a built-in junction box, to receive wiring in said elongate flexible gooseneck shaft from said lamp socket;

b) an electrical cord extending into said junction box for connecting to the wiring; and c) a plug on a distal free end of said electrical cord, whereby said plug can engage with a wall outlet to receive AC power therefrom, to supply electricity to said lamp socket when said switch is turned on.

14. A barbecue grill light as recited in claim 13, further including a socket mounted in said rectangular shaped casing and electrically connected to said electrical cord within said junction box, so that a plug on an electrical cord from a rotisserie motor on said barbecue grill can be plugged into said socket to receive AC power therefrom.

* * * * *